US007621281B2

(12) United States Patent
Ikemoto et al.

(10) Patent No.: US 7,621,281 B2
(45) Date of Patent: Nov. 24, 2009

(54) CLEANING SOLUTION FOR CLEANING SUBSTRATE FOR SEMICONDUCTOR DEVICES AND CLEANING METHOD USING THE SAME

(75) Inventors: Makoto Ikemoto, Kitakyushu (JP); Yasuhiro Kawase, Kitakyushu (JP); Hitoshi Morinaga, Kitakyushu (JP)

(73) Assignee: Mitsubishi Chemical Corporation, Tokyo (JP)

( * ) Notice: Subject to any disclaimer, the term of this patent is extended or adjusted under 35 U.S.C. 154(b) by 8 days.

(21) Appl. No.: 11/898,233

(22) Filed: Sep. 11, 2007

(65) Prior Publication Data

US 2008/0011321 A1 Jan. 17, 2008

Related U.S. Application Data

(60) Division of application No. 10/899,304, filed on Jul. 27, 2004, now abandoned, which is a continuation of application No. PCT/JP03/00714, filed on Jan. 27, 2003.

(30) Foreign Application Priority Data

Jan. 28, 2002 (JP) ..... 2002-018547

(51) Int. Cl.
*C11D 7/32* (2006.01)

(52) U.S. Cl. ..... 134/1.3; 134/2; 510/175

(58) Field of Classification Search ..... 134/1.3, 134/2; 510/175
See application file for complete search history.

(56) References Cited

U.S. PATENT DOCUMENTS

| | | | | |
|---|---|---|---|---|
| 5,147,454 | A | 9/1992 | Nishihara et al. | |
| 6,417,147 | B2 * | 7/2002 | Amemiya et al. | 510/175 |
| 7,064,070 | B2 * | 6/2006 | Mullee et al. | 438/691 |
| 2001/0001392 | A1 | 5/2001 | Hirae et al. | |
| 2001/0025017 | A1 * | 9/2001 | Amemiya et al. | 510/175 |
| 2002/0016272 | A1 | 2/2002 | Kakizawa et al. | |
| 2002/0155964 | A1 * | 10/2002 | Amemiya et al. | 510/175 |
| 2003/0089891 | A1 * | 5/2003 | Andreas | 252/500 |
| 2003/0144163 | A1 | 7/2003 | Morinaga et al. | |
| 2004/0099290 | A1 | 5/2004 | Morinaga et al. | |
| 2004/0116315 | A1 * | 6/2004 | Aoki et al. | 510/421 |
| 2004/0161933 | A1 * | 8/2004 | Takashima et al. | 438/689 |
| 2005/0040442 | A1 * | 2/2005 | Andreas et al. | 257/253 |
| 2005/0040443 | A1 * | 2/2005 | Andreas et al. | 257/253 |
| 2005/0199264 | A1 * | 9/2005 | Andreas | 134/2 |
| 2005/0229946 | A1 | 10/2005 | Hirae et al. | |
| 2006/0270573 | A1 * | 11/2006 | Ikemoto et al. | 510/175 |
| 2007/0006894 | A1 * | 1/2007 | Zhang et al. | 134/2 |

FOREIGN PATENT DOCUMENTS

| | | |
|---|---|---|
| EP | 1 047 121 A1 | 10/2000 |
| JP | 05-335294 | 12/1993 |
| JP | 06-13364 | 1/1994 |
| JP | 11-121418 | 4/1999 |
| JP | 2001-040389 | 2/2001 |
| JP | 2002-020787 | 1/2002 |
| JP | 2002-20787 | 1/2002 |

* cited by examiner

*Primary Examiner*—Gregory E Webb
(74) *Attorney, Agent, or Firm*—Nixon & Vanderhye P.C.

(57) ABSTRACT

A cleaning solution for cleaning a substrate for semiconductor devices and a cleaning method using the said cleaning solution, which comprises at least the following components (A), (B) and (C):

(A) an ethyleneoxide-type surfactant containing a hydrocarbon group which may have a substituent group except for phenyl, and a polyoxyethylene group in which a ratio (m/n) of a number (m) of carbon atoms contained in the hydrocarbon group to a number (n) of oxyethylene groups contained in the polyoxyethylene group is in the range of 1 to 1.5, the number (m) of carbon atoms is not less than 9, and the number (n) of oxyethylene groups is not less than 7;

(B) water; and (C) alkali or an organic acid.

19 Claims, No Drawings

CLEANING SOLUTION FOR CLEANING SUBSTRATE FOR SEMICONDUCTOR DEVICES AND CLEANING METHOD USING THE SAME

This application is a divisional of application Ser. No. 10/899,304 filed Jul. 27, 2004 now abandoned, which in turn is a continuation of PCT International Application No. PCT/JP03/00714, filed in Japanese on 27 Jan. 2003, which designated the US and claims priority to JP Application No. 2002-185477 filed 28 Jan. 2002. The entire contents of these applications are incorporated herein by reference.

TECHNICAL FIELD

The present invention relates to a cleaning solution for cleaning a substrate for semiconductor devices and a cleaning method using the same. Particularly, the present invention relates to a cleaning solution used for cleaning the surface of a substrate for semiconductor devices, which is made of semiconductors, glass, metals, ceramic materials, resins, magnetic materials, superconductors, etc., and tends to suffer from significant problems by contamination of metals or particles. More particularly, the present invention relates to a cleaning solution for cleaning the surface of a substrate for semiconductor devices, which is required to have a highly-cleaned surface, upon production of the semiconductor devices such as semiconductor elements and display devices, as well as a cleaning method using the cleaning solution.

According to the cleaning solution and the cleaning method of the present invention, in particular, the substrate for semiconductor devices having onto a partial or whole surface thereof, semiconductor materials such as silicon, insulating materials such as silicon nitride, silicon oxide, glass and low dielectric (Low-k) materials, transition metals, transition metal compounds, etc., can be highly cleaned without occurrence of roughness and corrosion by removing fine particles such as silica particles, alumina particles and organic substance particles, organic contaminants such as resist residues, and metal contaminants which are adhered onto the surface of the substrate, and further preventing re-adhesion of the thus removed contaminants onto the surface of the substrate.

BACKGROUND ARTS

In the process for production of semiconductor devices including flat panel displays such as TFT liquid crystal devices as well as microprocessors, memories and CCD, patterns or a thin film in the order of sub-microns or quarter-microns are formed on the surface of a substrate made of silicon, silicon oxide ($SiO_2$), glass or the like. Therefore, in the respective steps of such a production process, it is extremely important to highly clean the surface of the substrate by removing even a trace amount of contaminants therefrom. Among these contaminants, in particular, fine contaminants such as particle contaminants and metal contaminants are difficult to remove completely. However, since such contaminants tend to cause deterioration in electric properties and yield of the semiconductor devices, it is necessary to possibly remove the contaminants from the surface of the substrate prior to transferring the substrate to subsequent processes. In general, these contaminants are removed by cleaning the surface of the substrate using a cleaning solution.

In recent years, in the production of semiconductor devices, it is required to further enhance a throughput and a production efficiency thereof. In the substrate used for production of the semiconductor devices, which tend to be more and more reduced in size and highly integrated, it has been demanded to provide a cleaning solution and a cleaning method which are capable of not only removing particle contaminants and metal contaminants from the surface of the substrate, but also allowing the thus cleaned substrate to exhibit an excellent readhesion-preventing property after removal of these contaminants, thereby rapidly and highly cleaning the surface of the substrate.

In general, it is known that an aqueous alkali solution is useful as the cleaning solution for removing the particle contaminants. For the purpose of cleaning the surface of a substrate for semiconductor devices, there have been used aqueous alkali solutions such as an aqueous ammonia solution, an aqueous potassium hydroxide solution and an aqueous tetramethylammonium hydroxide solution. Further, there has been widely used a cleaning method ("SC-1 cleaning" or "APM cleaning") using a cleaning solution containing ammonia, hydrogen peroxide and water (also called "SC-1 cleaning solution" or "APM cleaning solution") (W. Kern and D. A. Puotinen "RCA Review", p. 187, June (1970)).

In addition, recently, in order to improve properties of such alkali cleaning solutions, specifically, in order to prevent the surface of the substrate for semiconductor devices from being etched and roughened, enhance a wettability of the surface of the substrate therewith, and improve a cleanability for removal of particle contaminants therefrom, there have been proposed various methods in which various surfactants are added to the alkali cleaning solutions.

For example, in order to prevent the surface of the substrate from being roughened by the cleaning solution, there has been proposed the method of adding a surfactant to an alkaline aqueous hydrogen peroxide solution to control a contact angle of the cleaning solution with the surface of the substrate to not more than 10° (Japanese Patent Application Laid-open (KOKAI) No. 5-335294 (1993)). In addition, in order to improve a wettability of the surface of the substrate with the cleaning solution, there has been proposed the hydrogen peroxide-containing alkali cleaning solution prepared by adding an ethyleneoxide-added nonionic surfactant in which the number of moles of ethyleneoxide added is 3 to 10 (Japanese Patent No. 3169024).

Further, in order to prevent the surface of a silicon substrate as a typical substrate for semiconductor devices from being etched, there has been proposed the method of adding various surfactants to an alkali cleaning solution (Japanese Patent Application Laid-open (KOKAI) No. 2001-40389). In particular, in order to improve a cleanability for removal of organic contaminants, there has been proposed the cleaning solution containing a specific surfactant which is used to clean the surface of the substrate for semiconductor devices (Japanese Patent Application Laid-open (KOKAI) No. 11-121418 (1999)). In order to improve a cleanability for removal of contaminants, there has also been proposed the method of adding alkylbenzenesulfonic acid to the hydrogen-peroxide-containing alkali cleaning solution (Japanese Patent Application Laid-open (KOKAI) No. 7-245281 (1995)). Further, in order to improve a cleanability for removal of particle contaminants, there has been proposed the method of adding a fluorine-based surfactant composed of a fluoroalkylsulfoneamide compound to an APM cleaning solution (Japanese Patent Application Laid-open (KOKAI) No. 5-251416 (1993)).

Further, in addition to the above alkali cleaning solution, an acid cleaning solution is also useful for cleaning the substrate for semiconductor devices. In general, the acid cleaning solution is effective to remove metal contaminants from the surface of the substrate, but is unsuitable for removing particle contaminants therefrom. For this reason, there have also been proposed the methods of adding various surfactants to the acid cleaning solution in order to improve a cleanability for removal of the particle contaminants, etc. For example, there has been proposed the method of cleaning a silicon wafer using a specific surfactant and hydrofluoric acid (Japanese Patent Application Laid-open (KOKAI) No. 7-216392 (1995)).

Further, there has been proposed the method of adding a surfactant and ozone to an aqueous hydrofluoric acid solution used for cleaning a silicon wafer (Japanese Patent Application Laid-open (KOKAI) No. 8-69990 (1996)). In addition, there has been proposed the method of adding an organic acid compound to a dispersant and/or surfactant in order to remove metal impurities and particle contaminants adsorbed onto the substrate provided on the surface thereof with a metal wiring (Japanese Patent Application Laid-open (KOKAI) No. 2001-7071).

In recent years, with the tendencies toward further reduction in size and highly-laminated structure of semiconductor devices, new metal materials such as copper (Cu) and tungsten (W) have been increasingly used as materials for a metal wiring connecting between fine semiconductor devices (hereinafter referred to merely as "wiring") or an electrode in the semiconductor devices (hereinafter referred to merely as "electrode"). More specifically, for example, as the wiring material, conventional aluminum (Al) has been recently replaced with copper (Cu) having a lower resistivity than that of Al.

Further, other new materials are also used for formation of inter layer dielectrics disposed between semiconductor devices having a laminated structure. As to the inter layer dielectrics, conventional $SiO_2$ films tend to be replaced with low dielectric films made of organic polymer materials or inorganic polymer materials having a lower dielectric than that of $SiO_2$. The inter layer dielectric is exposed to the surface of the substrate together with a metal wiring upon a cleaning step conducted after forming the metal wiring on the surface of the substrate (hereinafter occasionally referred to as "back end process") during the production process of the semiconductor devices.

Further, tungsten which has a low resistivity and is advantageous for fine processing, has been recently used as an electrode material. The electrode is usually exposed to the surface of the substrate upon a cleaning step conducted before forming the metal wiring thereon (hereinafter occasionally referred to as "front end process"). Conventionally, since the surface of the substrate to be cleaned in the front end process is wholly composed of a Si compound, even a trace amount of contaminants adhered thereonto adversely affect the resultant semiconductor devices. Therefore, it is necessary to highly clean the surface of the substrate, thereby essentially requiring a strong cleaning of the substrate by RCA cleaning method.

Further, in recent years, it has also been attempted to apply various proposals mentioned above to substrates using the above new materials that are exposed to the surface thereof, in order to highly clean the surface of the substrates.

The conventional back end process for cleaning the substrates having an Al wiring has been simply conducted using ultrapure water or an organic solvent since the Al wiring tends to be readily damaged by a strong acid or a strong alkali, and adverse influence thereon by metal contaminants in the back end process is lower than that in the front end process. However, when Cu is used instead of Al, there arise the following two additional problems.

First, since Cu is one of metal contaminants most unfavorable for Si, there arises such a problem that a diffusion velocity of Cu into an oxide film ($SiO_2$) formed on the surface of the semiconductor device is high, thereby causing much severer influences thereon as compared to those by Al.

Secondary, there is such a problem that Cu is incapable of dry-etching unlike Al. In order to produce a Cu wiring, it is inevitably required to use a method of previously forming a groove for the Cu wiring on an insulating film, subjecting the insulating film to copper-plating and then removing unnecessary portions of the copper-plated layer by CMP (Chemical Mechanical Polishing) method, i.e., a so-called Damasin method, or the like.

Upon forming the wiring by the above Damasin method, there arises such a problem that the Cu wiring or the low dielectric film were contaminated with a large amount of Cu used and abrasive particles (particles such as typically aluminum oxide particles) contained in a slurry used upon the CMP. Such contaminants on the surface of the substrate are no longer removed only by the simple cleaning method using ultrapure water or an organic solvent, thereby causing significant problems.

When the conventional RCA cleaning method using a strong acid or a strong alkali is used to remove the above contaminants, there arises such an additional problem that the new metal materials such as Cu and W are dissolved in hydrogen peroxide. In addition, the hydrophobic surface of the low dielectric film exhibits a poor wettability with the cleaning solution and, therefore, tends to repel the cleaning solution. As a result, in particular, it may be difficult to completely remove particle contaminants from the surface of the low dielectric film.

Accordingly, in the cleaning process for cleaning the substrate having the above new materials on the surface thereof, there will arise such a significant problem that the RCA cleaning solution containing hydrogen peroxide is no longer usable. For this reason, it has been strongly demanded to develop a new cleaning solution capable of cleaning the substrate whose surface contains the new metal materials that tend to be damaged by chemicals such as hydrogen peroxide.

To solve these problems, there have been developed the cleaning solutions containing various surfactants as described above. However, the conventional cleaning solutions have failed to exhibit a good cleanability for removing metal contaminants or particle contaminants, and sufficiently prevent re-adhesion of the contaminants removed, and further satisfy the following requirements (1) to (3), thereby causing problems upon cleaning the surface of the substrate.

(1) To be free from precipitation and white turbidity of the surfactant in the form of oil droplets in the cleaning solution at room temperature or upon heating, as well as deterioration in cleanability and residual oil droplets on the surface of the substrate;

(2) To have a low foaming property and show no adverse influences on the operation of a cleaning apparatus; and (3) Surfactant is made of materials that have no adverse influences on natural environment, and the waste cleaning solution is capable of being appropriately treated.

For example, since anionic surfactants usually have no cloud point, the cleaning solution containing such anionic surfactants can be used under a high temperature condition (e.g., not less than 80° C.), whereby a high-cleaning effect can be expected. However, since the anionic surfactants have a high foaming property, the use of a cleaning solution containing such anionic surfactants tends to adversely affect the operation of the cleaning apparatus.

Also, nonionic surfactants have a high cleanability and a low foaming property, but usually show a low cloud point. Therefore, when the cleaning solution containing such nonionic surfactants are used at a high temperature to attain a high-cleaning effect, the surfactants are coagulated in the form of oil droplets in the cleaning solution, thereby causing such a problem that residual oil droplets adhered onto the substrate are present after cleaning.

DISCLOSURE OF THE INVENTION

To solve the above conventional problems, the present inventors have performed earnest studies concerning the surfactant-containing cleaning solution for cleaning a substrate for semiconductor devices, and have noticed, in particular, surfactants used in the cleaning solution, more particularly, ethyleneoxide-type surfactants as nonionic surfactants.

The ethyleneoxide-type surfactants have a hydrocarbon group and a polyoxyethylene group in the same molecular structure. The present inventors have noticed the ethyleneoxide-type surfactants satisfying specific conditions in which a ratio (m/n) of the number (m) of carbon atoms contained in the hydrocarbon group to the number (n) of oxyethylene groups contained in the polyoxyethylene group is in the range of 1 to 1.5, the number (m) of carbon atoms is not less than 9, and the number (n) of oxyethylene groups is not less than 7.

Many of the ethyleneoxide-type surfactants satisfying the above specific conditions are in the form of a solid at room temperature under atmospheric pressure, and exhibit a low solubility in water. Therefore, the use of these ethyleneoxide-type surfactants have been avoided owing to poor handling property thereof in industrial production processes. However, a cleaning solution for cleaning a substrate for semiconductor devices containing alkali or an organic acid, which are prepared by heat-melting the ethyleneoxide-type surfactants satisfying the above specific conditions and then dissolving the surfactants in water, have unexpectedly exhibited a good cleanability notwithstanding substantially no hydrogen peroxide is contained therein. In particular, the cleaning solution is excellent in cleanability for fine particle contaminants (i.e., cleanability for removal of particles having a particle size of 0.1 μm order) which cannot be expected from ordinary cleaning effects thereof. In addition, the above cleaning solution for cleaning a substrate for semiconductor devices can also exhibit a sufficient wettability to the surface of a low dielectric film which tends to repel water due to a hydrophobic property thereof and is deteriorated in cleanability for removing particles therefrom, namely can show an excellent cleaning effect on such a film. The present invention has been attained on the basis of the above finding.

That is, in a first aspect of the present invention, there is provided a cleaning solution for cleaning a substrate for semiconductor devices, comprising at least the following components (A), (B) and (C):

(A) an ethyleneoxide-type surfactant including a hydrocarbon group which may have a substituent group except for phenyl, and a polyoxyethylene group in which a ratio (m/n) of the number (m) of carbon atoms contained in the hydrocarbon group to the number (n) of oxyethylene groups contained in the polyoxyethylene group is in the range of 1 to 1.5, the number (m) of carbon atoms is not less than 9, and the number (n) of oxyethylene groups is not less than 7;

(B) water; and (C) alkali or an organic acid.

The present invention is described in detail below. The cleaning solution of the present invention contains at least a specific surfactant as the component (A), water as the component (B) and alkali or an organic acid as the component (C).

The surfactant used as the component (A) in the present invention is an ethyleneoxide-type surfactant containing a hydrocarbon group which may have a substituent group except for phenyl, and a polyoxyethylene group in which a ratio (m/n) of the number (m) of carbon atoms contained in the hydrocarbon group to the number (n) of oxyethylene groups contained in the polyoxyethylene group is in the range of 1 to 1.5, the number (m) of carbon atoms is not less than 9, and the number (n) of oxyethylene groups is not less than 7.

When the ratio (m/n) is less than 1, the obtained cleaning solution tends to be insufficient in particle removability in the solution and anti-corrosiveness to silicon. In addition, due to the increase of a length of the oxyethylene chain, the surfactant tends to be deteriorated in solubility in water, resulting in increased burden for disposal treatment of the resultant waste cleaning solution. On the other hand, when the ratio (m/n) is more than 1.5, the alkali cleaning solution undesirably forms an O/W-type emulsion upon cleaning. Specifically, the surfactant is precipitated in the form of fine oil droplets, resulting in formation of white turbidity in the solution. As a result, there arise problems such as deteriorated cleanability and residual oil droplets on the substrate after cleaning. The ratio (m/n) is preferably in the range of 1 to 1.4.

When the number (m) of carbon atoms contained in the hydrocarbon group is less than 9, the particle removability of the cleaning solution tends to be deteriorated even though the ratio (m/n) falls within the optimum range. Also, when the number (m) of carbon atoms is too large, the surfactant tends to be deteriorated in solubility in water, and the burden for disposal treatment of the resultant waste cleaning solution is increased. Therefore, the number (m) of carbon atoms in the hydrocarbon group is preferably 9 to 16, more preferably 10 to 14. Meanwhile, in the case where the hydrocarbon group constituting the component (A) further has a hydrocarbon substituent group, the number (m) of carbon atoms means a total number of carbon atoms contained in the hydrocarbon group as a main chain thereof and those contained in the hydrocarbon substituent group.

Also, when the number (n) of oxyethylene groups contained in the polyoxyethylene group is less than 7, the particle removability of the cleaning solution tends to be deteriorated even though the ratio (m/n) falls within the optimum range. Also, when the number (n) of oxyethylene groups is too large, the burden for disposal treatment of the resultant waste cleaning solution is increased, and the surfactant tends to be readily decomposed in the cleaning solution. Therefore, the number (n) of oxyethylene groups contained in the polyoxyethylene group is preferably 7 to 16, more preferably 7 to 14.

By using the ethyleneoxide-type surfactant as defined in the present invention, it is possible to improve both a wettability of substrates with the cleaning solution and a particle removability. Examples of the ethyleneoxide-type surfactant may include polyoxyethylene alkyl ethers, polyoxyethylene fatty acid esters, polyoxyethylene alkyl amines, sulfuric acid salts of polyoxyethylene alkyl ethers or the like. Among these compounds, from the standpoints of good cleanability for removal of particle contaminants and re-adhesion preventing property, especially preferred are polyoxyethylene alkyl ethers represented by the following general formula (II):

$$R^2O—(CH_2CH_2O)_nH \quad (II)$$

wherein $R^2$ is an alkyl group which may be substituted with hydroxyl, amino, alkoxy or halogen; a number (m) of carbon atoms contained in the above alkyl group is not less than 9; and n is a number of not less than 7.

Specific examples of the above polyoxyethylene alkyl ethers may include polyoxyethylene (n=8) nonyl ether, polyoxyethylene (n=9) decyl ether, polyoxyethylene (n=11) undecyl ether, polyoxyethylene (n=10) lauryl ether, polyoxyethylene (n=11) lauryl ether, polyoxyethylene (n=10) tridecyl ether, polyoxyethylene (n=12) tridecyl ether, polyoxyethylene (n=11) tetradecyl ether, polyoxyethylene (n=13) tetradecyl ether, polyoxyethylene (n=12) pentadecyl ether, polyoxyethylene (n=14) pentadecyl ether, polyoxyethylene (n=12) cetyl ether, polyoxyethylene (n=15) cetyl ether, polyoxyethylene (n=18) oleyl ether or the like. Meanwhile, the number 'n' indicated in parenthesis of the above respective compounds represents 'n' in the above general formula (II).

In the present invention, a plurality of ethyleneoxide-type surfactants which are different in numbers m and n from each other, may be used in combination at an optional mixing ratio as long as the above specific conditions are satisfied. Further, when plural kinds of surfactants are used, the ratio (m/n) of each of the surfactants may be less than 1.0 or more than 1.5, the number (m) may be less than 9 and the number (n) may be less than 7, as far as an average value of the ratios (m/n) of the whole surfactants falls within the range of 1 to 1.5, an average value of the numbers (m) of the whole surfactants is not less than 9, and an average value of the numbers (n) of the whole surfactants is not less 7.

The content of the component (A) in the cleaning solution is usually 0.0001 to 1% by weight, preferably 0.0003 to 0.5% by weight, more preferably 0.001 to 0.1% by weight, still more preferably 0.001 to 0.05% by weight. When the content of the component (A) is too small, the cleaning solution tends to be insufficient in cleanability for removal of particle contaminants. On the other hand, when the content of the component (A) is too large, the cleanability for removal of particle contaminants is no longer improved, and rather remarkable foaming tends to be caused, so that the resultant solution becomes unsuitable for the cleaning process. Further, when subjecting the waste cleaning solution to biodegradation treatment, the burden therefor tends to be sometimes undesirably increased.

The component (A) as a commercially available product may sometimes contain metal impurities such as Na, K and Fe in an amount of about 1 to several thousands ppm. In such a case, the component (A) tends to act as a metal contaminant source. For this reason, the surfactant used as the component (A) is preferably subjected to purification treatment before use. The amount of the respective metal impurities contained in the surfactant is usually not more than 10 ppm, preferably not more than 1 ppm, more preferably not more than 0.1 ppm. As the purification method, there may be suitably used, for example, the method of dissolving the surfactant in water and then passing the obtained solution through an ion-exchange resin to capture the metal impurities by the resin.

By using the thus purified component (A), it is possible to produce a cleaning solution which is extremely minimized in contents of metal impurities. In the cleaning solution of the present invention, among the metal impurities, the content of each of at least Na, Mg, Al, K, Ca, Fe, Cu, Pb and Zn is preferably not more than 20 ppb, more preferably not more than 5 ppb, still more preferably not more than 0.1 ppb.

Meanwhile, in the present invention, surfactants other than the component (A) may be used as long as the addition thereof adversely affect the effects of the present invention. Examples of the surfactants other than the component (A) may include any of cationic surfactants, anionic surfactants and nonionic surfactants. Among these surfactants, preferred are anionic surfactants and nonionic surfactants. Specific examples of the anionic surfactants may include alkylbenzenesulfonic acids having carbon atoms of 8 to 12 and salts thereof, alkylmethyltauric acids having carbon atoms of 8 to 12 and salts thereof, alkylsulfuric esters having carbon atoms of 8 to 12 and salts thereof or the like. Examples of the nonionic surfactants may include those surfactants composed of polyoxyalkylene solely.

In the present invention, water is used as the component (B). In order to obtain a substrate having a highly cleaned surface, as the component (B), there may be usually used deionized water, preferably ultrapure water. Also, there may be used electrolytic ionized water obtained by electrolysis of water, hydrogen water prepared by dissolving a hydrogen gas in water, or the like.

In the present invention, alkali or an organic acid is used as the component (C). That is, the cleaning solution of the present invention is an alkali cleaning solution or an acid cleaning solution.

The kind of alkali used in the present invention is not particularly limited, and typical examples of the alkali may include ammonium hydroxide (aqueous ammonia solution) and organic alkalis. Specific examples of the organic alkalis may include quaternary ammonium hydroxide, and amine compounds such as amines and amino alcohols. The quaternary ammonium hydroxide preferably has an alkyl group having carbon atoms of 1 to 4 or a hydroxyalkyl group having carbon atoms of 1 to 4, which may be substituted with hydroxy, alkoxy or halogen. The substituent groups may be the same or different from each other.

Examples of the above alkyl group may include lower alkyl groups having carbon atoms of 1 to 4, such as methyl, ethyl, propyl and butyl, and examples of the above hydroxyalkyl group may include lower hydroxyalkyl groups having carbon atoms of 1 to 4, such as hydroxymethyl, hydroxyethyl, hydroxypropyl and hydroxybutyl.

Specific examples of the quaternary ammonium hydroxide having the above substituent groups may include tetramethylammonium hydroxide (TMAH), tetraethylammonium hydroxide, trimethyl(hydroxyethyl)ammonium hydroxide (common name: "choline"), triethyl(hydroxyethyl)ammonium hydroxide or the like. Examples of the amine compounds may include ethylenediamine, monoethanol amine, triethanol amine or the like.

Among these alkalis, form the standpoints of cleaning effect and less residual metals as well as inexpensiveness and stability of the obtained cleaning solution, preferred are ammonium hydroxide, tetramethylammonium hydroxide (TMAH) and trimethyl(hydroxyethyl)ammonium hydroxide (common name: "choline"). These alkalis may be used alone or in combination of any optional two or more thereof.

The concentration of the alkali contained in the cleaning solution may be appropriately determined, and is preferably controlled to such that the pH value of the cleaning solution is not less than 9. When the alkali concentration is too low, namely the pH value of the cleaning solution is not high, it may be difficult to attain a good cleanability for removal of contaminants as aimed by the present invention. On the other hand, even though the pH value of the cleaning solution is too high, the effect corresponding to increase in the pH value is no longer attained, and rather the use of such a high alkali concentration is uneconomical. In addition, there arises a risk that the surface of the substrate is damaged by etching with such a high-concentration alkali. Therefore, the pH value of the alkali cleaning solution is preferably 9 to 13, more preferably 10 to 12.5, still more preferably 10.5 to 12.

The kind of organic acid used in the present invention is not particularly limited, and the organic acid preferably includes organic carboxylic acids or organic sulfonic acids. Typical examples of the organic carboxylic acids may include formic acid, acetic acid, propionic acid, butyric acid, isobutyric acid, valeric acid, ethylmethylacetic acid, trimethylacetic acid, oxalic acid, succinic acid, malonic acid, citric acid, tartaric acid, malic acid or the like. Of these organic acids, preferred is at least one acid selected from the group consisting of acetic acid, propionic acid, oxalic acid, succinic acid, malonic acid, citric acid, tartaric acid and malic acid, and more preferred is at least one acid selected from the group consisting of acetic acid, oxalic acid and citric acid. Of these compounds, still more preferred is acetic acid, because the acetic acid is ordinarily used as an etchant material for semiconductor substrates and, therefore, inexpensive and readily available in the form of high-purity acetic acid having a less content of metal impurities by distillation treatment thereof, and further is free from formation of particles due to evaporation of water therefrom.

Typical examples of the organic sulfonic acids may include methanesulfonic acid, ethanesulfonic acid, n-propanesulfonic acid, i-propanesulfonic acid, n-butanesulfonic acid, phenylsulfonic acid or the like. Of these organic sulfonic acids, preferred are methanesulfonic acid and/or ethanesulfonic acid, and more preferred is methanesulfonic acid. The above organic acids may be used alone or in combination of any two or more thereof at an optional mixing ratio.

The concentration of the organic acid contained in the cleaning solution may be appropriately determined, and is preferably controlled such that the pH value of the acid cleaning solution is 1 to 5. When the organic acid concentration is too low, namely the pH value of the cleaning solution is not sufficiently low, it may be difficult to attain a good cleanability for removal of contaminants as well as re-adhesion preventing effect as aimed by the present invention. On the other hand, even though the organic acid concentration is too high, the effect corresponding to decrease in the pH value is no longer attained, and rather the use of such a high organic acid concentration is uneconomical. In addition, the surface of the substrate tends to be corroded with such a high-concentration acid. Therefore, the pH value of the acid cleaning solution is preferably 2 to 3.

In the present invention, a cleaning solution further containing a complexing agent is more preferable since the substrate cleaned therewith has an extremely highly cleaned surface that is further minimized in content of metal contaminants. As the complexing agent, there may be optionally used conventionally known complexing agents. The kind of complexing agent used may be determined by totally considering contamination level on the surface of the substrate, kind of metal contaminants, cleaning degree required for the surface of the substrate, costs for the complexing agent, chemical stability, etc. For example, there may be used the following compounds (1) to (4).

(1) Compounds having nitrogen as a donor atom, and a carboxyl group and/or a phosphonic acid group:

Examples of the compounds (1) may include amino acids such as glycine; nitrogen-containing carboxylic acids such as imino-diacetic acid, nitrilo-triacetic acid, ethylenediaminetetraacetic acid (EDTA), trans-1,2-diaminocyclohexanetetraacetic acid (CyDTA), diethylenetriaminepentaacetic acid (DTPA) and triethylenetetraminehexaacetic acid (TTHA); nitrogen-containing phosphonic acids such as ethylenediaminetetrakis(methylenephosphonic acid) (EDTPO), nitrilotris(methylenephosphonic acid) (NTPO) and propylenediaminetetra(methylenephosphonic acid) (PDTMP); or the like.

(2) Compounds having an aromatic hydrocarbon ring and at least two groups of OH group and/or $O^-$ group which are directly bonded to carbon atoms constituting the aromatic hydrocarbon ring:

Examples of the compounds (2) may include phenols such as catechol, resorcinol and tiron, or derivatives thereof.

(3) Compounds having both structures of the compounds (1) and (2):

(3-1) Ethylenediaminediorthohydroxyphenylacetic acid [EDDHA] and derivatives thereof:

Examples of the compounds (3-1) may include aromatic nitrogen-containing carboxylic acids such as ethylenediaminediorthohydroxyphenylacetic acid (EDDHA), ethylenediamine-N,N'-bis[(2-hydroxy-5-methylphenyl)acetic acid] (EDDHMA), ethylenediamine-N,N'-bis[(2-hydroxy-5-chlorophenyl)acetic acid] (EDDHCA) and ethylenediamine-N,N'-bis[(2-hydroxy-5-sulfophenyl)acetic acid] (EDDHSA); aromatic nitrogen-containing phosphonic acids such as ethylenediamine-N,N'-bis[(2-hydroxy-5-methylphenyl)phosphonic acid] and ethylenediamine-N,N'-bis[(2-hydroxy-5-phosphophenyl)phosphonic acid]; or the like.

(3-2) N,N'-bis(2-hydroxybenzyl)ethylenediamine-N,N'-diacetic acid (HBED) and derivatives thereof:

Examples of the compounds (3-2) may include N,N'-bis(2-hydroxybenzyl)ethylenediamine-N,N'-diacetic acid (HBED), N,N'-bis(2-hydroxy-5-methylbenzyl)ethylenediamine-N,N'-diacetic acid (HMBED), N,N'-bis(2-hydroxy-5-chlorobenzyl)ethylenediamine-N,N'-diacetic acid or the like.

(4) Other compounds:

Examples of the other compounds (4) may include amines such as ethylenediamine, 8-quinolinol and o-phenathroline; carboxylic acids such as formic acid, acetic acid, oxalic acid and tartaric acid; hydrogen halides such as hydrofluoric acid, hydrochloric acid, hydrogen bromide and hydrogen iodide, and salts thereof; oxo acids such as phosphoric acid and condensed phosphoric acid, and salts thereof; or the like.

The complexing agent may be used in the form of either an acid or a base such as ammonium salts.

Among the above complexing agents, from the standpoints of cleaning effect and chemical stability, preferred are nitrogen-containing carboxylic acids such as ethylenediaminetetraacetic acid (EDTA) and diethylenetriaminepentaacetic acid (DTPA); nitrogen-containing phosphonic acids such as ethylenediaminetetrakis(methylenephosphonic acid) (EDTPO) and propylenediaminetetra(methylenephosphonic acid) (PDTMP); ethylenediaminediorthohydroxyphenylacetic acid (EDDHA) and derivatives thereof; and N,N'-bis(2-hydroxybenzyl)ethylenediamine-N,N'-diacetic acid (HBED).

In particular, among of these complexing agents, from the standpoint of the cleaning effect, more preferred are ethylenediaminediorthohydroxyphenylacetic acid [EDDHA], ethylenediamine-N,N'-bis[(2-hydroxy-5-methylphenyl)acetic acid] [EDDHMA], diethylenetriaminepentaacetic acid (DTPA), ethylenediaminetetraacetic acid (EDTA) and propylenediaminetetra(methylenephosphonic acid) (PDTMP). These complexing agents may be used alone or in combination of any two or more thereof at an optional mixing ratio.

The concentration of the complexing agent in the cleaning solution may be optionally selected according to kind and amount of metal impurities as contaminants and a cleaning degree required for the surface of the substrate, and is usually 1 to 10000 ppm, preferably 5 to 1000 ppm, more preferably 10 to 200 ppm. When the concentration of the complexing agent is too low, it may be difficult to attain a contaminant-removing effect and a re-adhesion preventing effect by the complexing agent. When the concentration of the complexing agent is too high, the use of such a high-concentration complexing agent is economically disadvantageous since the effects corresponding thereto are no longer attained, and there is an increased risk that the complexing agent is adhered onto the surface of the substrate and still remained thereon even after the surface treatment.

Meanwhile, the complexing agent as a commercially available reagent usually contains metal impurities such as Fe, Al and Zn in an amount of 1 to several thousands ppm. Therefore, the complexing agent used in the present invention is considered to sometimes act as a source of metal contaminants. These metals are initially present in the form of a stable complex with the complexing agent, but tend to be isolated from the complex upon decomposition thereof, and adhered onto the surface of the substrate while the surface cleaning solution is used for a long period of time. For this reason, in the present invention, the complexing agent is preferably previously purified before use. The purified complexing agent contains the respective metal impurities in an amount of usually not more than 5 ppm, preferably not more than 1 ppm, more preferably not more than 0.1 ppm. As the purifying method, there may be suitably used, for example, the method of dissolving the complexing agent in an acid or alkali solution, removing insoluble impurities by filtration, neutralizing the solution again to precipitate crystals, and then separating the obtained crystals from the solution.

Also, the cleaning solution of the present invention may contain other components at optional ratios unless the addition of these components adversely affects properties of the cleaning solution. Examples of the other components may include sulfur-containing organic compounds such as 2-mercaptothiazoline, 2-mercaptoimidazoline, 2-mercaptoethanol and thioglycerol; nitrogen-containing organic compounds such as benzotriazole, alkylbenzotriazole, tetrazole, 3-aminotriazole, $N(R)_3$ wherein R is an alkyl group having carbon atoms of 1 to 4, $N(ROH)_3$ (wherein R is an alkyl group having carbon atoms of 1 to 4), urea and thiourea; water-soluble polymers such as polyethylene glycol and polyvinyl alcohol; anticorrosives such as alkyl alcohol-based compounds (ROH wherein R is an alkyl group having carbon atoms of 1 to 4); acids such as sulfuric acid and hydrochloric acid; reducing agents such as hydrazine; dissolved gases such as hydrogen, argon and nitrogen; etching accelerators such as hydrofluoric acid, ammonium fluoride and BHF that are expected to exhibit the effect of removing polymers firmly adhered after dry-etching, etc.

The cleaning solution of the present invention may further contain as the other components, oxidants such as hydrogen peroxide, ozone and oxygen. In the cleaning process for cleaning a substrate for semiconductor devices, when the surface of a substrate having no oxide film (bare silicon) is to be cleaned, blending of the antioxidant in the cleaning solution is preferred in order to prevent the surface of the substrate from being roughened upon etching the surface of the substrate. When the alkali cleaning solution of the present invention contains hydrogen peroxide, the concentration of hydrogen peroxide in the cleaning solution is usually 0.01 to 5% by weight, preferably 0.1 to 1% by weight.

Meanwhile, wiring or electrodes of semiconductor devices which are made of metal materials that are dissolved by the reaction with hydrogen peroxide, tend to be sometimes exposed onto the surface of the substrate to be cleaned. Examples of these metal materials may include transition metals such as Cu and W, and transition metal compounds. The cleaning solution used for cleaning the surface of such a substrate preferably contains substantially no hydrogen peroxide. The cleaning solution of the present invention can exhibit a sufficient cleanability without adversely affecting these metal materials unlike conventional APM cleaning solutions even though substantially no hydrogen peroxide is contained therein.

Meanwhile, in the present invention, the wording "containing substantially no hydrogen peroxide" means that hydrogen peroxide, if any, is contained in such a small amount that materials on the substrate to be cleaned, e.g., wiring materials or electrode materials such as Cu and W as well as low dielectric films are free from adverse influences by hydrogen peroxide such as corrosion and deterioration in quality. In other words, it is meant that those materials can have sufficient functions as wiring or electrode when finished into semiconductor devices. For this purpose, the opportunity of incorporating hydrogen peroxide into the cleaning solution of the present invention is possibly avoided, and even if contained therein, the content of hydrogen peroxide in the cleaning solution is preferably controlled to the minimum level. The content of hydrogen peroxide in the cleaning solution is, for example, not more than 10 ppm, preferably not more than 1 ppm, more preferably not more than 10 ppb.

The cleaning solution of the present invention is used to clean the surface of the substrate of semiconductors, glass, metals, ceramic materials, resins, magnetic materials, superconductors, etc., which tend to undergo significant problems by contamination with metals or particles. In particular, the cleaning solution of the present invention is more suitably used to clean the surface of the substrate for semiconductor devices such as semiconductor elements and display devices, which is required to have a highly cleaned surface, upon production of the substrate for semiconductor devices. These substrates may be provided on the surface thereof with wiring and electrodes. Examples of materials for the wiring and electrode may include semiconductor materials such as Si, Ge, Ga and As; insulating materials such as $SiO_2$, silicon nitride, glass, low-dielectric materials, aluminum oxide, transition metal oxides such as titanium oxide, tantalum oxide, hafnium oxide and zirconium oxide, $(Ba, Sr)TiO_3$ (BST), polyimides, and organic thermosetting resins; metals such as W, Cu and Al or alloys, silicides and nitrides thereof; or the like. The low-dielectric materials generally include those materials having a dielectric constant of not more than 3.5. Meanwhile, the dielectric constant of $SiO_2$ is in the range of 3.8 to 3.9.

In particular, the cleaning solution of the present invention is suitably used for cleaning the substrate for semiconductor devices, which has transition metals or transition metal compounds on the surface thereof. Examples of the transition metals may include W, Cu, Ti, Cr, Co, Zr, Hf, Mo, Ru, Au, Pt, Ag, etc. Examples of the transition metal compounds may include nitrides, oxides, silicides, etc., of these transition metals. Of these metals and compounds, preferred are W and/or Cu.

As the process for cleaning a substrate having tungsten on the surface thereof, there may be exemplified a cleaning process for cleaning the surface of a substrate having a tungsten gate electrode, silicon, etc. More specifically, the cleaning process includes a cleaning step after forming a tungsten film on the semiconductor device, in particular, a cleaning step after dry-etching the tungsten film and a subsequent cleaning step after ion implantation into exposed silicon portions thereof.

By using the cleaning solution according to the present invention, it is possible to remove particles or metals without megasonic irradiation and brush-scrubbing. Therefore, the cleaning solution of the present invention can be suitably used for cleaning the surface of the substrate formed thereon an extremely tungsten fine gate electrode (e.g., having a gate electrode width of about 0.15 μm) which tends to be broken by megasonic cleaning or brush-scrubbing.

As a process for cleaning a substrate having Cu on the surface thereof, there may be exemplified such a cleaning process for cleaning the surface of the substrate having on the surface thereof a Cu wiring, an inter layer dielectric, etc. More specifically, the cleaning process includes a cleaning step after forming a Cu film on the semiconductor device, in particular, a cleaning step after subjecting the Cu film to CMP (chemical mechanical polishing) and a cleaning step after forming holes through the inter layer dielectric on the wiring by dry-etching.

In addition, the cleaning solution of the present invention can also be suitably used for cleaning a substrate for semiconductor devices, which has on the surface thereof a low-dielectric material as an inter layer dielectric material. The low-dielectric materials are generally classified into three kinds of materials, i.e., organic polymer materials, inorganic polymer (siloxane-based) materials and porous materials. Examples of the organic polymer materials may include polyimides, BCB (benzocyclobutane), "Flare" produced by Honeywell Inc., "Silk" produced by Dow Chemical Corp., or the like. Examples of the inorganic polymer materials may include FSG (fluorinated silicate glass), "BLACK DIAMOND" produced by Applied Materials Corp., "Aurora" produced by Nippon ASM, Co. Ltd., or the like.

As described above, the cleaning solution of the present invention can be suitably used for cleaning the surface of a substrate for semiconductor devices irrespective of whether or not any electrode or wiring material is present thereon. In particular, the cleaning solution of the present invention is more suitable for cleaning a substrate for semiconductor devices, which exhibits such a hydrophobic property that a contact angle between the surface of the substrate and water is not less than 60°.

The cleaning solution of the present invention may be produced by conventionally known methods. Specifically, after mixing two or three or more constituting components of the cleaning solution (e.g., surfactant, ammonium hydroxide, water, and optional other components such as complexing agent, if required) with each other, the resultant mixture may be blended with the remaining components. Alternatively, all of the constituting components may be blended together at the same time.

As described above, the cleaning solution for a substrate for semiconductor devices according to the present invention exhibits substantially no corrosiveness against even such a substrate for semiconductor devices which has on the surface thereof, future new materials, namely, metal materials showing a low resistance to chemicals such as hydrogen peroxide. Therefore, the cleaning solution of the present invention is a cleaning solution having an excellent cleaning effect which can be used in either the front end process or back end process.

That is, in another aspect of the present invention, there is provided a cleaning solution for a substrate for semiconductor devices which comprises at least a semiconductor device electrode and a metal wiring on the surface thereof, said cleaning solution satisfying the following requirements (a), (b) and (c):

(a) having substantially no corrosiveness against the semiconductor device electrode and the metal wiring;

(b) upon cleaning the substrate having a metal contaminant content of not more than 1000 to 5000 ($\times 10^{10}$ atoms/cm$^2$) by the cleaning solution, a metal contaminant content in the substrate being reduced to not more than $10\times 10^{10}$ atoms/cm$^2$ after cleaning; and (c) upon cleaning the surface of the substrate having an approximately circular shape with a radius of 'r' in which particles having a particle size of not less than 0.1 μm are present at a ratio of 8000/0.03 m$^2$ to 100000/0.03 m$^2$, for a time 't' (min), numbers of the particles present in circular surface areas with radiuses of 0.6r and 0.9r which have the same center as that of the surface of the substrate, being reduced to not more than 200/t and not more than 800/t, respectively, after cleaning when the time 't' is 0.5 to 1.

Meanwhile, the above requirements (b) and (c) are definitions as to properties of the cleaning solution according to the present invention, and are not intended to define cleaning conditions under which the cleaning solution of the present invention is used. Also, in the cleaning solution of the present invention, the wording "having substantially no corrosiveness against the semiconductor device electrode and the metal wiring" described in the above means that the cleaning solution causes no adverse influences such as corrosion or deterioration in quality, against the semiconductor device electrode or the metal wiring on the substrate to be cleaned, more specifically, the electrode material or wiring material such as, for example, W and Cu, such that these materials can have sufficient functions as an electrode or a wiring even when finished into a semiconductor device.

The cleaning solution of the present invention which satisfies the above requirements (b) and (c) is capable of sufficiently removing both of metal contaminants and particle contaminants from the substrate.

When the above requirement (c) is satisfied, in the case where the surface of the substrate to be cleaned has an approximately circular shape, i.e., in the case where the surface of an approximately circular substrate is cleaned by the cleaning solution, it becomes possible to highly clean the surface of the substrate irrespective of positions thereof even for a short cleaning time. More specifically, after cleaning the surface of the substrate having an approximately circular shape with a radius of 'r' on which particles having a particle size of not less than 0.1 μm are present at a ratio of 8000/0.03 m$^2$ to 100000/0.03 m$^2$, for a time 't' of 0.5 to 1 (min) using the cleaning solution, the particles present within a circular surface area with a radius of 0.6r which has the same center as that of the above surface of the substrate and is located at a relatively inner portion of the substrate, is removed therefrom such that the number of the particles is reduced to not more than 200/t, and further the particles present within a circular surface area with a radius of 0.9r which has the same center as that of the above surface of the substrate and is located at a relatively outer portion of the substrate, is removed therefrom such that the number of the particles is reduced to not more than 800/t, thereby enabling the surface of the substrate to be highly cleaned.

Also, in the above requirements of the cleaning solution for a substrate for semiconductor devices according to the present invention, the wording "upon cleaning" means such a case where the substrate for semiconductor devices is cleaned with the cleaning solution by the cleaning method as mentioned below. The cleaning method is not particularly limited as long as the method can be usually employed upon cleaning the substrate for semiconductor devices. Among them, as the method of contacting the cleaning solution with the substrate, from the standpoint of attaining stable cleaning results, there may be preferably used a spin-type contacting method of rotating the substrate at a high speed while flowing the cleaning solution on the substrate, upon which the temperature of the cleaning solution is controlled in the range of from room temperature to 90° C.

Further, there may also be used the cleaning method using a physical force, for example, mechanical cleaning method such as scrub-cleaning using a cleaning brush, an megasonic cleaning method in which an megasonic wave having a frequency of not less than 0.5 MHz is irradiated on the substrate, or the combination of these cleaning methods. The use of these physical cleaning methods is preferable since more stable cleaning results can be attained.

The cleaning method used in the present invention is preformed by directly contacting the cleaning solution with the substrate. As the method of contacting the cleaning solution with the substrate, there may be used a dip-type contacting method in which the substrate is dipped in a cleaning tank filled with the cleaning solution, a spin-type contacting method in which the substrate is rotated at a high speed while flowing the cleaning solution from a nozzle onto the substrate, a spray-type contacting method in which the substrate is cleaned by spraying the cleaning solution thereonto, or the like. As an apparatus for performing the above cleaning methods, there may be used a batch-type cleaning apparatus in which a plurality of substrates accommodated in a cassette are cleaned at the same time, a single wafer-type cleaning apparatus in which a single substrate fitted to a holder is cleaned, or the like.

The cleaning time is usually from 30 sec to 30 min, preferably from 1 to 15 min for the batch-type cleaning apparatus, and usually from 1 sec to 15 min, preferably from 5 sec to 5 min for the single wafer-type cleaning apparatus. When the cleaning time is too short, it may be difficult to attain a sufficient cleaning effect. When the cleaning time is too long, the corresponding cleaning effect is not attainable, thereby causing deterioration in throughput. The cleaning solution of the present invention may be applied to the substrate by any of the above methods. From the standpoint of removing contaminants more efficiently for a short period of time, the use of the spin-type or spray-type cleaning method is more preferred. In addition, when the cleaning solution of the present invention is applied to the single wafer-type cleaning apparatus having problems concerning shortening of cleaning time and reduction in amount of the cleaning solution used, these problems can be suitably eliminated.

The temperature of the cleaning solution used is usually room temperature. In order to enhance the cleaning effect, the cleaning solution is preferably heated to a temperature of about 40 to 70° C. Further, when the substrate to be cleaned has silicon exposed onto the surface thereof, residual organic contaminants tend to be deposited on the surface of the silicon. Therefore, in such a case, it is preferred that the cleaned substrate is heat-treated at a temperature of not less than 300° C. to heat-decompose the organic deposited, or subjected to ozone water treatment to oxidation-decompose the organic deposited.

Also, the cleaning method of the present invention may be preferably used in combination with the physical cleaning method, for example, mechanical cleaning method such as scrub-cleaning using a cleaning brush or megasonic cleaning method. In particular, when megasonic irradiation or brush-scrubbing is used in combination with the cleaning solution of the present invention, the particle contaminant removability is further enhanced, leading to reduction in cleaning time. In addition, the cleaning after CMP is preferably conducted using a brush made of resins.

The resin material of the brush may be optionally selected, for example, the brush may be prepared from PVA (polyvinyl alcohol). Also, when the substrate is irradiated with an megasonic wave having a frequency of not less than 0.5 MHz, the particle contaminant removability can be remarkably enhanced owing to the synergistic effect with the surfactant. Further, prior to and/or subsequent to conducting the cleaning method of the present invention, the substrate may be cleaned with electrolytic ionized water obtained by electrolysis of water, or hydrogen water prepared by dissolving a hydrogen gas in water.

PREFERRED EMBODIMENT OF THE PRESENT INVENTION

The present invention is described in more detail by Examples, but the Examples are only illustrative and not intended to limit the scope of the present invention.

Examples 1 and 2 and Comparative Examples 1 to 3

Evaluation of Cleanability for Removal of Particle Contaminants by Scrub-Cleaning A 8-inch silicon substrate (a disk-shaped substrate having a radius r of 4 inches) having a low dielectric film (SiOC: carbon-containing $SiO_2$) was dipped in a $SiO_2$ slurry solution for 10 min. The substrate was taken out of the solution, rinsed with ultrapure water for 1 min, and then spin-dried using a multi-spinner "KSSP-201" manufactured by Kaijo Co., Ltd. Thereafter, the number of fine particles adhered onto the surface of the substrate was measured using a laser surface inspection apparatus "LS-5000" manufactured by Hitachi Denshi Engineering Co., Ltd. As a result, it was confirmed that not less than a predetermined number (upper limit: 100000) of $SiO_2$ particles having a particle size of not less than 0.2 μm were adhered onto the surface of the substrate.

Then, using the cleaning solution shown in Table 1, the substrate adhered with $SiO_2$ particles was subjected to brush-scrub cleaning using a brush made of PVA to remove the $SiO_2$ particles therefrom. The cleaning using the cleaning solution was carried out at room temperature for 1 min. Thereafter, the substrate was rinsed with ultrapure water for 1 min, and then spin-dried, thereby obtaining a cleaned substrate. The results are shown in Table 1.

TABLE 1

| | Cleaning agent components Surfactant | | | | |
|---|---|---|---|---|---|
| | Structural formula | m | n | m/n | Conc. (ppm) |
| Example 1 | $C_{12}H_{25}O(C_2H_4O)_{11}H$ | 12 | 11 | 1.1 | 50 |
| Example 2 | $C_{12}H_{25}O(C_2H_4O)_{11}H$ | 12 | 11 | 1.1 | 50 |
| Comparative Example 1 | — | — | — | — | — |
| Comparative Example 2 | $C_{12}H_{25}$-ph-$SO_3H$ | — | — | — | 40 |
| Comparative Example 3 | Ultrapure water only | | | | |

| | Cleaning agent components | | | | Number of adhered particles of 0.2 μm or larger (per wafer) | |
|---|---|---|---|---|---|---|
| | Alkali | | Complexing agent | | | |
| | Kind | Conc. (ppm) | Kind | Conc. (ppm) | Before cleaning | after cleaning |
| Example 1 | TMAH | 50 | EDDHA | 100 | >8000 | 59 |
| Example 2 | TMAH | 50 | — | — | | 65 |
| Comparative Example 1 | TMAH | 50 | EDDHA | 100 | | 515 |
| Comparative Example 2 | TMAH | 70 | EDDHA | 100 | | 250 |
| Comparative Example 3 | Ultrapure water only | | | | | 2355 |

Note:
Cleaning method: Scrub-type cleaning (cleaning temperature: room temperature; cleaning time t: 1 min)
Measuring apparatus: "LS-5000" manufactured by Hitachi Denshi Engineering Co., Ltd. (edge cut: 40 mm)
The number of particles on the surface of a substrate before cleaning was 8000 to 100000 per 0.03 $m^2$.
The number of particles after cleaning was the number of particles present in a circular area with a radius of 0.6 r which had the same center as that of the substrate.

Examples 3 to 6 and Comparative Examples 4 to 8

Evaluation of Cleanability for Removal of Particle Contaminants by Scrub-Cleaning First, the substrate adhered with $SiO_2$ particles was prepared by the same method as defined in Example 1. Then, the substrate adhered with $SiO_2$ particles was cleaned by the same method as defined in Example 1 except that the cleaning solution shown in Table 2 was used, and the cleaning time was 0.5 min, thereby obtaining a cleaned substrate. The results are shown in Table 2.

The wettability shown in Table 2 was evaluated by the following method. That is, a test piece (2 cm square) having a low dielectric film (SiOC: carbon-containing $SiO_2$) was vertically dipped in the respective cleaning solutions shown in Table 2. After 0.5 min, the test piece was vertically taken out from the cleaning solution, and the wettability was evaluated by a ratio of a surface area adhered with the cleaning solution to a whole surface area of the test piece. The evaluation results were classified into the following ranks: A: not less than 80%; B: from 50% to less than 80%; and C: less than 50%.

TABLE 2

| | Cleaning agent components Surfactant | | | | |
|---|---|---|---|---|---|
| | Structural formula | m | n | m/n | Conc. (ppm) |
| Example 3 | $C_{12}H_{25}O(C_2H_4O)_9H$ | 12 | 9 | 1.3 | 50 |
| Example 4 | $C_{12}H_{25}O(C_2H_4O)_{11}H$ | 12 | 11 | 1.1 | 50 |
| Example 5 | $C_{13}H_{27}O(C_2H_4O)_{10}H$ | 13 | 10 | 1.3 | 50 |
| Example 6 | $C_{16}H_{33}O(C_2H_4O)_{13}H$ | 16 | 13 | 1.2 | 50 |
| Comparative Example 4 | $C_8H_{17}O(C_2H_4O)_8H$ | 8 | 8 | 1.0 | 50 |
| Comparative Example 5 | $C_{12}H_{25}O(C_2H_4O)_7H$ | 12 | 7 | 1.7 | 50 |
| Comparative Example 6 | $C_{12}H_{25}O(C_2H_4O)_{13}H$ | 12 | 13 | 0.9 | 50 |
| Comparative Example 7 | $C_{16}H_{33}O(C_2H_4O)_{20}H$ | 16 | 20 | 0.8 | 50 |
| Comparative Example 8 | $C_{18}H_{37}O(C_2H_4O)_{20}H$ | 18 | 20 | 0.9 | 50 |

| | Cleaning agent components | | | | | Number of adhered particles of 0.2 μm or larger (per wafer) | |
|---|---|---|---|---|---|---|---|
| | Alkali | | Complexing agent | | | | |
| | Kind | Conc. (ppm) | Kind | Conc. (ppm) | Wettability | Before cleaning | after cleaning |
| Example 3 | TMAH | 50 | EDDHA | 100 | A | >8000 | 1321 |
| Example 4 | TMAH | 50 | EDDHA | 100 | A | | 1012 |
| Example 5 | TMAH | 50 | EDDHA | 100 | A | | 1123 |
| Example 6 | TMAH | 50 | EDDHA | 100 | A | | 1524 |
| Comparative Example 4 | TMAH | 50 | EDDHA | 100 | C | | 4924 |
| Comparative Example 5 | TMAH | 50 | EDDHA | 100 | C | | 2061 |
| Comparative Example 6 | TMAH | 50 | EDDHA | 100 | C | | 1712 |
| Comparative Example 7 | TMAH | 50 | EDDHA | 100 | A | | 1776 |
| Comparative Example 8 | TMAH | 50 | EDDHA | 100 | B | | 2926 |

Note:
Cleaning method: Scrub-type cleaning (cleaning temperature: room temperature; cleaning time t: 0.5 min)
Measuring apparatus: "LS-5000" manufactured by Hitachi Denshi Engineering Co., Ltd. (edge cut: 10 mm)
The number of particles on the surface of a substrate before cleaning was 8000 to 100000 per 0.03 $m^2$.
The number of particles after cleaning was the number of particles present in a circular area with a radius of 0.9 r which had the same center as that of the substrate.

Examples 7 and 10

Evaluation of Cleanability for Removal of Particle Contaminants by Scrub-Cleaning A 8-inch silicon substrate (a disk-shaped substrate having a radius r of 4 inches) having a low dielectric film (SiOC: carbon-containing $SiO_2$) was surface-treated with 0.5 wt % hydrofluoric acid for 1 min, and then dipped in a $SiO_2$, slurry solution for 10 min. Next, the substrate was taken out of the solution, rinsed with ultrapure water for 1 min, and spin-dried using a multi-spinner "KSSP-201" manufactured by Kaijo Co., Ltd. Thereafter, the number of fine particles adhered onto the surface of the substrate was measured using a laser surface inspection apparatus "LS-6600" manufactured by Hitachi Denshi Engineering Co., Ltd. As a result, it was confirmed that not less than a predetermined number (upper limit: 100000) of $SiO_2$ particles having a particle size of not less than 0.11 μm were adhered onto the surface of the substrate.

Then, using the cleaning solution shown in Table 3, the substrate adhered with $SiO_2$ particles was subjected to brush-scrub cleaning using a brush made of PVA to remove the $SiO_2$ particles therefrom. The cleaning using the cleaning solution was carried out at room temperature for 0.5 min. Thereafter, the substrate was rinsed with ultrapure water for 1 min, and then spin-dried, thereby obtaining a cleaned substrate. The results are shown in Table 3.

TABLE 3

| | Cleaning agent components Surfactant | | | | |
|---|---|---|---|---|---|
| | Structural formula | m | n | m/n | Conc. (ppm) |
| Example 7 | $C_{12}H_{25}O(C_2H_4O)_{11}H$ | 12 | 11 | 1.1 | 50 |
| Example 8 | $C_{12}H_{25}O(C_2H_4O)_{11}H$ | 12 | 11 | 1.1 | 200 |
| Example 9 | $C_{12}H_{25}O(C_2H_4O)_{11}H$ | 12 | 11 | 1.1 | 50 |
| Example 10 | $C_{12}H_{25}O(C_2H_4O)_{11}H$ | 12 | 11 | 1.1 | 200 |

| | Cleaning agent components | | | | | |
|---|---|---|---|---|---|---|
| | Alkali | | Acid | | Complexing agent | |
| | Kind | Conc. (ppm) | Kind | Conc. (ppm) | Kind | Conc. (ppm) |
| Example 7 | TMAH | 75 | — | — | EDDHA | 100 |
| Example 8 | TMAH | 1000 | — | — | EDDHA | 100 |
| Example 9 | — | — | acetic acid | 0.45 | — | — |
| Example 10 | — | — | acetic acid | 0.45 | — | — |

| | pH of cleaning agent | Number of adhered particles of 0.11 μm or larger (per wafer) | |
|---|---|---|---|
| | | Before cleaning | after cleaning |
| Example 7 | 10.5 | >20000 | 838 |
| Example 8 | 12 | | 792 |
| Example 9 | 2.5 | | 497 |
| Example 10 | 2.5 | | 813 |

Note:
Cleaning method: Scrub-type cleaning (cleaning temperature: room temperature; cleaning time t: 0.5 min)
Measuring apparatus: "LS-6600" manufactured by Hitachi Denshi Engineering Co., Ltd. (edge cut: 10 mm)
The number of particles on the surface of a substrate before cleaning was 20000 to 100000 per 0.03 $m^2$.
The number of particles after cleaning was the number of particles present in a circular area with a radius of 0.9 r which had the same center as that of the substrate.

Examples 11 and 12 and Comparative Example 9

Evaluation of Cleanability for Removal of Particle Contaminants by Scrub-Cleaning First, the substrate adhered with $SiO_2$ particles was prepared by the same method as defined in Example 1. Then, the substrate adhered with $SiO_2$ particles was cleaned by the same method as defined in Example 1 except that the cleaning solution shown in Table 4 was used, and the cleaning time was 0.5 min, thereby obtaining a cleaned substrate. The results are shown in Table 4.

TABLE 4

| | Cleaning agent components Surfactant | | | | |
|---|---|---|---|---|---|
| | Structural formula | m | n | m/n | Conc. (ppm) |
| Example 11 | $C_{12}H_{25}O(C_2H_4O)_{11}H$ | 12 | 11 | 1.1 | 50 |
| Example 12 | $C_{12}H_{25}O(C_2H_4O)_{11}H$ | 12 | 11 | 1.1 | 50 |
| Comparative Example 9 | Demoule AS | — | — | — | 10000 |

| | Cleaning agent components Acid | | Number of adhered particles of 0.2 μm or larger (per wafer) | |
|---|---|---|---|---|
| | Kind | Conc. (wt %) | Before cleaning | after cleaning |
| Example 11 | Acetic acid | 2.25 | >8000 | 248 |
| Example 12 | Citric acid | 10 | | 290 |
| Comparative Example 9 | Citric acid | 10 | | 2455 |

Note:
"Demoule AS": β-naphthalenesulfonic acid/formalin condensate
Cleaning method: Scrub-type cleaning (cleaning temperature: room temperature; cleaning time t: 0.5 min)
Measuring apparatus: "LS-5000" manufactured by Hitachi Denshi Engineering Co., Ltd. (edge cut: 40 mm)
The number of particles on the surface of a substrate before cleaning was 8000 to 100000 per 0.03 $m^2$.
The number of particles after cleaning was the number of particles present in a circular area with a radius of 0.6 r which had the same center as that of the substrate.

Example 13 and Comparative Example 10

A 4-inch silicon substrate (a disk-shaped substrate having a radius r of 2 inches) provided on the surface thereof with a thermal oxide film having a thickness of about 100 nm, was exposed to atmospheric air for 3 h to adhere suspended matters in air thereonto. As result of measuring the surface of the substrate using a surface inspection apparatus "LS-5000" manufactured by Hitachi Denshi Engineering Co., Ltd., it was confirmed that not less than 10000 (upper limit: 100000) particles having a particle size of not less than 0.2 μm were adhered onto the surface of the substrate. The substrate was dipped in the respective cleaning solutions shown in Table 3 which were controlled at a temperature of 50° C., for 10 min, rinsed with a flowing pure water for 10 min, and then dried by a spin dryer. After cleaning, the number of residual particles on the substrate was measured. The results are shown in Table 5.

Comparative Example 11

The same evaluation procedure as defined in Example 13 was conducted except that a solution (APM cleaning solution) prepared by mixing a 29 wt % ammonium hydroxide aqueous solution, a 30 wt % hydrogen peroxide aqueous solution and ultrapure water with each other at a volume ratio of 1:4:20. The results are shown in Table 5.

The substrate cleaned with the cleaning solution of Comparative Example 11 contained a relatively less number of adhered particles after cleaning. However, since the cleaning solution contained hydrogen peroxide, it was not possible to apply the cleaning solution to the new materials, and the cleaning solution will become unusable in future.

TABLE 5

| | Cleaning agent components Surfactant | | | | |
|---|---|---|---|---|---|
| | Structural formula | m | n | m/n | Conc. (ppm) |
| Example 13 | $C_{12}H_{25}O(C_2H_4O)_{11}H$ | 12 | 11 | 1.1 | 25 |
| Comparative Example 10 | — | — | — | — | — |
| Comparative Example 11 | — | — | — | — | — |

| | Cleaning agent components Alkali | | pH of | Number of adhered particles of 0.2 μm or larger (per wafer) | |
|---|---|---|---|---|---|
| | Kind | Conc. (ppm) | cleaning agent | Before cleaning | after cleaning |
| Example 13 | $NH_4OH$ | 2800 | 11.3 | >10000 | 756 |
| Comparative Example 10 | $NH_4OH$ | 2800 | 11.3 | | 1866 |
| Comparative Example 11 | APM | 6000 | 10.3 | | 1145 |

Note:
APM: Solution prepared by mixing 29 wt % aqueous ammonia, 30 wt % hydrogen peroxide aqueous solution and pure water at a volume ratio of 1:2:40.
Cleaning temperature: 50° C.; cleaning time t: 10 min (edge cut: 10 mm)

Example 14 and Comparative Examples 12 to 14

A 4-inch silicon substrate (a disk-shaped substrate having a radius r of 2 inches) provided on the surface thereof with a natural oxide film was dipped in a 0.5 wt % HF aqueous solution for 5 min, thereby obtaining a substrate from which the surface oxide film was removed. The substrate was then dipped for 10 min in the respective cleaning solutions as shown in Table 4 to which 0.02 g/L of silicon (IV) nitride particles "Stk#12145" produced by Johnson Matthey Corp., were added and whose temperature was controlled to 50° C. The substrate was taken out of the solution, rinsed with a flowing pure water for 5 min, and then dried by a spin dryer. After cleaning, the number of residual particles having a particle size of not less than 0.2 μm which were adhered on the substrate was measured using a surface inspection apparatus "LS-5000" manufactured by Hitachi Denshi Engineering Co., Ltd. The results are shown in Table 6.

TABLE 6

| | Cleaning solution components Surfactant | | | | |
|---|---|---|---|---|---|
| | Structural formula | m | n | m/n | Conc. (ppm) |
| Example 14 | $C_{12}H_{25}O(C_2H_4O)_{11}H$ | 12 | 11 | 1.1 | 25 |
| Comparative Example 12 | ADEKA L-44 | — | — | — | 25 |
| Comparative Example 13 | UNISAFE DC1100 | — | — | — | 25 |
| Comparative Example 14 | — | — | — | — | — |

| | Cleaning solution components Alkali | | pH of | Number of adhered particles of 0.2 μm or larger (per wafer) |
|---|---|---|---|---|
| | Kind | Conc. (ppm) | cleaning solution | After dipping treatment |
| Example 14 | $NH_4OH$ | 2800 | 11.3 | 296 |
| Comparative Example 12 | $NH_4OH$ | 2800 | 11.3 | 3888 |
| Comparative Example 13 | $NH_4OH$ | 2800 | 11.3 | 3208 |
| Comparative Example 14 | $NH_4OH$ | 2800 | 11.3 | >10000 |

Note:
"ADEKA L-44" produced by Asahi Denka Kogyo Co., Ltd.; block copolymer of oxyethylene and oxypropylene; molecular weight: 2200
"UNISAFE DC1100" produced by Nippon Yushi Co., Ltd.; block copolymer of oxyethylene and oxybutylene; molecular weight: 1100
Treating temperature: 50° C.; treating time t: 10 min (edge cut: 10 mm)

Example 15 and Comparative Examples 15 and 16

A 4-inch silicon substrate (a disk-shaped substrate having a radius r of 2 inches) was dipped in a 0.5 wt % HF aqueous solution for 5 min, thereby preparing a substrate from which a surface natural oxide film was removed. The substrate was then dipped for a predetermined period of time in the respective cleaning solutions as shown in Table 5 which were controlled to the respective temperatures as shown. Next, the substrate was taken out of the solution, rinsed with a flowing pure water for 5 min, and then dried by a spin dryer. Immediately after drying the substrate, the standard deviation Rms (nm) of Z-axis displacement on the surface of the substrate was measured using an atomic force microscope "Nano Scope IIIa" manufactured by Digital & nbsp Instruments Inc. The results are shown in Table 7.

The surface roughness of the substrate was visually observed, thereby obtaining the following results. That is, in Comparative Examples 15 and 16, there was observed a roughened surface of the substrate including numerous crater-like irregularities having a diameter of about 1 to 10 mm formed on the surface of the substrate as well as interference patterns formed over the whole surface of the substrate. On the other hand, in Example 15, such a roughened surface of the substrate was not observed.

TABLE 7

| | Cleaning solution components Surfactant | | | | |
|---|---|---|---|---|---|
| | Structural formula | m | n | m/n | Conc. (ppm) |
| Example 15 | $C_{12}H_{25}O(C_2H_4O)_{11}H$ | 12 | 11 | 1.1 | 25 |
| Comparative Example 15 | — | — | — | — | — |
| Comparative Example 16 | — | — | — | — | — |

| | Cleaning solution components Alkali | | pH of | Treating | Treating | |
|---|---|---|---|---|---|---|
| | Kind | Conc. (ppm) | cleaning solution | temp. (° C.) | time (min) | Rms (nm) |
| Example 15 | $NH_4OH$ | 2800 | 11.3 | 50 | 10 | 0.281 |
| Comparative Example 15 | $NH_4OH$ | 2800 | 11.3 | 40 | 10 | 4.328 |

TABLE 7-continued

| | | | | | | |
|---|---|---|---|---|---|---|
| Comparative Example 16 | $NH_4OH$ | 2800 | 11.3 | 50 | 10 | 3.074 |

Note:
Treating temperature: 40° C. or 50° C.; treating time t: 10 min

Examples 16 to 19 and Comparative Examples 17 to 19

A silicon substrate was dipped in a 0.5 wt % HF aqueous solution for 5 min, thereby preparing a polycrystalline polysilicon test piece having a thickness of about 100 nm from which a surface oxide film was removed. The test piece was then dipped for 10 min in the respective cleaning solutions as shown in Table 9 which were controlled to a temperature of 50° C. The substrate was taken out of the solution, rinsed with a flowing pure water for 5 min, and then dried by blowing nitrogen. The thickness of the polycrystalline polysilicon test piece was measured using a photo-interference type film thickness measuring apparatus "NANOSPEC L-6100" manufactured by Nanometrics Co., Ltd. Form the measured thicknesses before and after cleaning, the etching rate was calculated. The results are shown in Table 8.

TABLE 8

| | Cleaning solution components Surfactant | | | | |
|---|---|---|---|---|---|
| | Structural formula | m | n | m/n | Conc. (ppm) |
| Example 16 | $C_{12}H_{25}O(C_2H_4O)_{11}H$ | 12 | 11 | 1.1 | 5 |
| Example 17 | $C_{12}H_{25}O(C_2H_4O)_{11}H$ | 12 | 11 | 1.1 | 10 |
| Example 18 | $C_{12}H_{25}O(C_2H_4O)_{11}H$ | 12 | 11 | 1.1 | 25 |
| Example 19 | $C_{12}H_{25}O(C_2H_4O)_{11}H$ | 12 | 11 | 1.1 | 100 |
| Comparative Example 17 | — | — | — | — | — |
| Comparative Example 18 | PEG 400 | — | 8.7 | — | 1000 |
| Comparative Example 19 | UNIOX M-400 | 1 | 8.4 | 0.1 | 1000 |

| | Cleaning solution components Alkali | | pH of | |
|---|---|---|---|---|
| | Kind | Conc. (ppm) | cleaning solution | Etching rate (nm/min) |
| Example 16 | $NH_4OH$ | 2800 | 11.3 | 0.48 |
| Example 17 | $NH_4OH$ | 2800 | 11.3 | 0.52 |
| Example 18 | $NH_4OH$ | 2800 | 11.3 | 0.43 |
| Example 19 | $NH_4OH$ | 2800 | 11.3 | 0.34 |
| Comparative Example 17 | $NH_4OH$ | 2800 | 11.3 | 6.26 |
| Comparative Example 18 | $NH_4OH$ | 2800 | 11.3 | 2.69 |
| Comparative Example 19 | $NH_4OH$ | 2800 | 11.3 | 1.91 |

Note:
"PEG 400" produced by Nippon Yushi Co., Ltd.; oxyethylene condensation polymer; molecular weight: 400
"UNIOX M-400" produced by Nippon Yushi Co., Ltd.; monomethyl ether of oxyethylene condensation polymer; molecular weight: 400
Treating temperature: 50° C.; treating time t: 10 min

Example 20 and Reference Example 1

A tungsten substrate was dipped in a 0.3 wt % ammonia aqueous solution for 5 min, thereby preparing a tungsten test piece having a thickness of about 100 nm from which a surface oxide film was removed. The thus obtained test piece was then dipped for 10 min in the respective cleaning solutions as shown in Table 9 which were controlled to a temperature of 40° C. The substrate was taken out of the solution, rinsed with a flowing pure water for 5 min, and then dried by blowing nitrogen. The thickness of the tungsten test piece was calculated from a reflection intensity thereof measured using a total reflection fluorescent X-ray analyzer "RIX-3000" manufactured by Jeol Co., Ltd. Form the thus measured thicknesses before and after cleaning, the etching rate was calculated. The results are shown in Table 9.

As apparently recognized from the comparison between Example 20 and Reference Example 1, the cleaning solution of the present invention was more effective for suppressing the etching rate on the surface of the substrate as compared to the simple aqueous alkali solution. Therefore, it was confirmed that the cleaning solution of the present invention was more excellent as a cleaning solution for a substrate for semiconductor devices.

Comparative Example 20

The same evaluation procedure as defined in Example 20 was conducted except that the APM cleaning solution used in Comparative Example 11 was used. The results are shown in Table 9.

TABLE 9

| | Cleaning solution components Surfactant | | | | |
|---|---|---|---|---|---|
| | Structural formula | m | n | m/n | Conc. (ppm) |
| Example 20 | $C_{12}H_{25}O(C_2H_4O)_{11}H$ | 12 | 11 | 1.1 | 25 |
| Reference Example 1 | — | — | — | — | — |
| Comparative Example 20 | — | — | — | — | — |

| | Cleaning solution components Alkali | | pH of | |
|---|---|---|---|---|
| | Kind | Conc. (ppm) | cleaning solution | Etching rate (nm/min) |
| Example 20 | $NH_4OH$ | 2800 | 11.3 | 0.071 |
| Reference Example 1 | $NH_4OH$ | 2800 | 11.3 | 0.080 |
| Comparative Example 20 | APM | 6000 | 10.4 | >10 |

Note:
APM: Solution prepared by mixing 29 wt % aqueous ammonia, 30 wt % hydrogen peroxide aqueous solution and pure water at a volume ratio of 1:2:40.
Treating temperature: 40° C.; treating time t: 10 min

Example 21 and Comparative Example 21

A 4-inch silicon substrate (disk-shaped substrate having a radius r of 2 inches) was dipped in an APM cleaning solution containing metal ions (Fe, Cu). The APM cleaning solution was prepared by mixing a 29 wt % aqueous ammonia, a 31 wt % hydrogen peroxide aqueous solution and water at a volume ratio of 1:1:5, and then adding a metal ion-containing aqueous solution to the resultant mixture such that Fe and Cu contents in the obtained cleaning solution were 20 ppb and 1 ppm, respectively. Next, the silicon substrate was taken out of the solution, rinsed with ultrapure water for 10 min, and then dried by blowing nitrogen, thereby obtaining a silicon substrate contaminated with the metals.

The analysis of the metal contaminants adhered onto the silicon substrate both before and after the cleaning was performed by the following method. That is, the metals adhered onto the surface of the substrate were recovered by treating the substrate with an aqueous solution containing 0.1% by weight of hydrofluoric acid and 1% by weight of hydrogen peroxide, and then the amounts of the thus recovered metals were measured using an inductively coupled plasma mass spectrometer "ICP-MS" to calculate the metal concentrations (atoms/$cm^2$) on the surface of the substrate.

The above silicon substrate contaminated with the metals was cleaned at 60° C. for 10 min by a dipping method using the cleaning solution shown in Table 10. The results of analysis of the contaminated substrate as well as residual metals (Fe, Cu) adhered onto the surface of the cleaned substrate are shown in Table 10.

TABLE 10

| | Cleaning agent components Surfactant | | | | |
|---|---|---|---|---|---|
| | Structural formula | m | n | m/n | Conc. (ppm) |
| Example 21 | $C_{12}H_{25}O(C_2H_4O)_{11}H$ | 12 | 11 | 1.1 | 50 |
| Comparative Example 21 | — | — | — | — | — |

Before cleaning (silicon wafer contaminated with metals)

| | Cleaning agent components | | | | Metal removability: concentration ($\times 10^{10}$ atoms/$cm^2$) | |
|---|---|---|---|---|---|---|
| | Alkali | | Complexing agent | | | |
| | Kind | Conc. (ppm) | Kind | Conc. (ppm) | Fe | Cu |
| Example 21 | TMAH | 50 | EDDHA | 100 | 5.2 | <1 |
| Comparative Example 21 | TMAH | 50 | — | — | 682 | 139 |
| | Before cleaning (silicon wafer contaminated with metals) | | | | 1000-3000 | 3000-5000 |

Note:
Cleaning method: Dipping type cleaning
Cleaning temperature: 60° C.; cleaning time t: 10 min As is apparent from the above results, it is confirmed that the cleaning solution of the present invention is excellent in cleanability for removal of fine particles adhered onto the hydrophobic low dielectric film. Further, it is confirmed that the cleaning solution of the present invention is more excellent in cleanability for removal of particles derived from suspended matters in air as compared to the conventional cleaning methods using an ammonium hydroxide solution or an APM solution.

Similarly, even though fine particles, etc., are entered into the cleaning system, the fine particles, etc, can be prevented from adhering onto the substrate by removing these substances by the cleaning method of the present invention. Further, even when the alkali cleaning solution is used, the silicon substrate is extremely effectively prevented from suffering from a rough surface as compared to the conventional cleaning methods. Therefore, since the polysilicon or tungsten substrate is free from undesired side effects such as dimensional change upon processing due to etching, thereby attaining both a good cleanability without forming a rough surface and a low-etching property.

In addition, the cleaning solution of the present invention can exhibit an excellent cleaning effect against even such a substrate for semiconductor devices which is provided on the surface thereof with the materials having a poor resistance to chemicals such as hydrogen peroxide, and can be used in both a front end process and a back end process of the semiconductor production process.

INDUSTRIAL APPLICABILITY

When the cleaning solution of the present invention is used to clean the substrate for semiconductor devices which is provided on a partial or whole surface thereof with semiconductor materials such as silicon, insulating materials such as silicon nitride, silicon oxide, glass and low-dielectric materials, transition metals or transition metal compounds, it is possible to effectively remove the fine particles, organic contaminants and metal contaminants adhered onto the surface of the substrate. Further, even if the fine particles are entered into the cleaning system, these particles can be prevented from adhering onto the substrate. In particular, the cleaning solution can improve a wettability of hydrophobic low-dielectric materials that tend to repel chemicals and, therefore, can exhibit an excellent cleanability therefor. In addition, even the alkali cleaning solution can exhibit, in addition to a good cleanability, both a roughness-suppressing property and a low-etching property for the surface of a silicon substrate. Accordingly, the cleaning solution of the present invention can provide a very useful surface treating method for removing contaminants therefrom upon production of semiconductor devices, display devices, etc., from industrial viewpoints.

The invention claimed is:

1. A method for cleaning a substrate for semiconductor devices comprising:

chemical mechanical polishing a substrate for semiconductor devices which is provided on a partial or whole surface thereof with silicon, transition metals or transition metal compounds, and cleaning the substrate using a cleaning solution, said cleaning solution comprising at least the following components (A), (B) and (C):

(A) a polyoxyethylene alkyl ether surfactant containing a hydrocarbon group which may have a substituent group except for phenyl, and a polyoxyethylene group in which a ratio (m/n) of a number (m) of carbon atoms contained in the hydrocarbon group to a repeating number (n) of oxyethylene groups contained in the polyoxyethylene group is in the range of 1 to 1.2, the number (m) of carbon atoms is not less than 9, and in which the number of oxyethylene groups is 7 to 18;

(B) water; and (C) an alkali.

2. A method according to claim 1, wherein the cleaning solution further comprises a complexing agent.

3. A method according to claim 1, wherein the cleaning solution has a pH value of not less than 9.

4. A method according to claim 1, wherein the component (C) is represented by the general formula (I):

$$(R^1)_4N^{30}OH^- \quad (I)$$

wherein $R^1$ is a hydrogen atom or an alkyl group which may be substituted with hydroxyl, alkoxy or halogen, and the $R^1$ groups may be the same or different from each other.

5. A method according to claim 4, wherein the component (C) is ammonium hydroxide or quaternary ammonium hydroxide having a $C_1$ to $C_4$ alkyl group or a hydroxyalkyl group.

6. A method according to claim 1, wherein a content of the component (A) is 0.0001 to 0.5% by weight.

7. A method according to claim 1, wherein the substrate is cleaned while irradiating a megasonic wave having a frequency of not less than 0.5 MHz thereto.

8. A method according to claim 1, wherein the substrate after chemical mechanical polishing is subjected to brush cleaning.

9. A method according to claim 1, wherein the cleaning solution is heated to a temperature of 40 to 70° C. upon use.

10. A method according to claim 1, wherein after cleaning the substrate with the cleaning solution, the substrate is further heat-treated at a temperature of not less than 300 °C. or treated with ozone water.

11. A method according to claim 1, wherein the substrate to be treated by the method has an insulating film having a water contact angle of not less than 60° on the surface thereof.

12. A method according to claim 1, wherein the transition metal on the surface of substrate is copper.

13. A cleaning solution for cleaning a substrate for semiconductor devices, comprising at least the following components (A), (B) and (C):

(A) a polyoxyethylene alkyl ether represented by the following general formula (II):

$$R^2—(CH_2CH_2O)_nH \quad (II)$$

wherein $R^2$ is an alkyl group which may be substituted with hydroxyl, amino, alkoxy or halogen; a ratio (m/n) of a number (m) of carbon atoms contained in the hydrocarbon group to a repeating number (n) of oxyethylene groups contained in the polyoxyethylene group is in the range of 1 to 1.2, the number (m) of carbon atoms is not less than 9, and in which the number of oxyethylene groups is 7 to 18;

(B) water; and (C) an alkali.

14. A cleaning solution according to claim 13, further comprises a complexing agent.

15. A cleaning solution according to claim 13, having a pH value of not less than 9.

16. A cleaning solution according to claim 13, wherein the component (C) is represented by the general formula (I):

$$(R^1)_4N^{30}\,OH^- \quad (I)$$

wherein $R^1$ is a hydrogen atom or an alkyl group which may be substituted with hydroxyl, alkoxy or halogen, and the $R^1$ groups may be the same or different from each other.

17. A cleaning solution according to claim 16, wherein the component (C) is ammonium hydroxide or quaternary ammonium hydroxide having a $C_1$ to $C_4$ alkyl group or a hydroxyalkyl group.

18. A cleaning solution according to claim 13, wherein a content of the component (A) is 0.0001 to 0.5% by weight.

19. A cleaning solution according to claim 13, wherein the substrate for semiconductor devices which is provided on a partial or whole surface thereof with copper.

* * * * *